US007331409B2

(12) United States Patent
Cole et al.

(10) Patent No.: US 7,331,409 B2
(45) Date of Patent: Feb. 19, 2008

(54) CONFIGURABLE BEACON AND METHOD

(75) Inventors: Scott B. Cole, Edmond, OK (US); Michael R. Campbell, Perry, OK (US); Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 301 days.

(21) Appl. No.: 10/503,327

(22) PCT Filed: Feb. 24, 2004

(86) PCT No.: PCT/US2004/005921

§ 371 (c)(1),
(2), (4) Date: Nov. 5, 2004

(87) PCT Pub. No.: WO2004/076799

PCT Pub. Date: Sep. 10, 2004

(65) Prior Publication Data

US 2005/0115706 A1 Jun. 2, 2005

Related U.S. Application Data

(60) Provisional application No. 60/449,823, filed on Feb. 24, 2003.

(51) Int. Cl.
*E21B 47/24* (2006.01)

(52) U.S. Cl. ..... 175/45; 166/255.2

(58) Field of Classification Search ..... 166/254.1, 166/255.1, 255.2; 175/45
See application file for complete search history.

(56) References Cited

U.S. PATENT DOCUMENTS

| | | | | |
|---|---|---|---|---|
| 6,095,260 | A * | 8/2000 | Mercer et al. | 175/45 |
| 6,279,668 | B1 * | 8/2001 | Mercer | 175/45 |
| 2003/0006071 | A1 * | 1/2003 | Stump et al. | 175/61 |
| 2005/0023036 | A1 * | 2/2005 | Cole et al. | 175/26 |
| 2005/0199424 | A1 * | 9/2005 | Stump et al. | 175/45 |
| 2006/0124355 | A1 * | 6/2006 | Brune et al. | 175/45 |

* cited by examiner

*Primary Examiner*—David Bagnell
*Assistant Examiner*—Robert E Fuller
(74) *Attorney, Agent, or Firm*—Tomlinson & O'Connell, PC

(57) ABSTRACT

A monitoring system is used to monitor the location and orientation of a downhole tool assembly by detecting an output signal. The downhole tool assembly has a beacon assembly with one or more configurable operation parameters. A transmitting assembly transmits an operation instruction signal to the beacon assembly to configure the operation parameters. The detected operation instruction signal is processed by the beacon assembly and the operation parameter is configured. The transmitting assembly may be separate from the monitoring system and have an input assembly. The input assembly allows the operator to input predetermined operation parameters into the transmitting assembly that are then transmitted to the beacon assembly. In a preferred embodiment, the configurable operation parameters may include the intensity and/or frequency of the output signal, the calibration and resolution of orientation sensors, and the rate at which data is transmitted from the beacon assembly.

28 Claims, 10 Drawing Sheets

ROLL CALIBRATION ROUTINE

CONFIGURABLE BEACON AND METHOD

CROSS REFERENCE TO RELATED APPLICATION

This application claims the benefit of U.S. Provisional Application No. 60/449,823, filed on Feb. 24, 2003, the contents of which are incorporated herein fully by reference.

FIELD OF THE INVENTION

The present invention relates generally to the field of determining the location and orientation of underground objects, and in particular to the configuration of beacons and sensors used to monitor the orientation and location of a downhole tool assembly.

SUMMARY OF THE INVENTION

The present invention is directed to a horizontal directional drilling system. The horizontal directional drilling system comprises a horizontal directional drilling machine, a drill string, a downhole tool assembly, a transmitting assembly and a beacon assembly. The drill string is operatively connected to the horizontal directional drilling machine and the downhole tool assembly is supported on the drill string. The transmitting assembly comprises a transmitter adapted to transmit at least an operation instruction signal. The beacon assembly is supported by the downhole tool assembly and comprises at least a configurable operation parameter.

The beacon assembly further comprises a receiver, a processor, and a transmitter. The receiver is adapted to detect the operation instruction signal from the transmitting assembly and to communicate the detected operation instruction signal. The processor is supported by the beacon assembly and is adapted to receive the detected operation instruction signal from the receiver. Further, the processor is adapted to configure the operation parameter of the beacon assembly in response to the detected operation instruction signal. The transmitter transmits an output signal from the beacon assembly.

The invention further includes a beacon assembly having at least a configurable operation parameter for use with a horizontal directional drilling system having a transmitting assembly. The transmitting assembly comprises a transmitter adapted to transmit an operation instruction signal. The beacon assembly comprises a receiver, a processor, and a transmitter. The receiver is adapted to detect the operation instruction signal from the transmitting assembly and to transmit the detected operation instruction signal. The processor is adapted to receive the detected operation instruction signal from the receiver. Further, the processor is adapted to process the operation instruction signal and to configure the operation parameter of the beacon assembly in response to the detected operation instruction signal. The transmitter is adapted to transmit an output signal.

Still yet, the present invention is directed to a method for monitoring the location and orientation of a downhole tool assembly using a monitoring system. The downhole tool assembly has a beacon assembly comprising at least a configurable operation parameter. The method comprises transmitting an output signal from the beacon assembly indicative of the configurable operation parameter, detecting the output signal, processing the output signal to determine a value for the configurable operation parameter. Using the determined value, an operation instruction is transmitted to the beacon assembly to alter the configurable operation parameter of the beacon assembly to obtain a desired operation parameter.

Further still, the present invention is directed to a method of determining the distance between a downhole tool assembly and a monitoring system. The method comprises positioning the downhole tool assembly and monitoring system a known distance from each other. Next, a proportionality constant value is selected. The magnetic field is then transmitted from the downhole tool assembly and detected. An estimated distance between the monitoring system and the downhole tool assembly is calculated based upon the detected intensity of the magnetic field and the selected proportionality constant value. An operation instruction is transmitted to the downhole tool assembly. The operation instruction signal is indicative of the estimated distance between the downhole tool assembly and the monitoring system. The intensity or signal strength of the magnetic field transmitted by the downhole tool assembly is changed so that the estimated distance calculated by the monitoring system is substantially equal to the known distance.

In yet another embodiment, the present invention is directed to a method for monitoring the location and orientation of a beacon assembly located below ground, the beacon assembly comprising at least a configurable operation parameter. The method comprises sensing a configurable operation parameter of the beacon assembly, processing the configurable operation parameter, transmitting an operation instruction to the beacon assembly, and altering the configurable operation parameter of the beacon assembly in response to the operation instruction.

BRIEF DESCRIPTION OF THE FIGURES

FIG. 1 further illustrates the use of a monitoring system to monitor the position and orientation of the downhole tool assembly.

FIG. 5 also illustrates optional hardware that may be carried by the monitoring system.

In FIG. 6 the transmitting assembly is separate from the monitoring system.

FIG. 9 is a flow chart illustrating the steps used to adjust the intensity or signal strength of the transmitter output signal.

BRIEF DESCRIPTION OF THE INVENTION

Horizontal directional drilling ("HDD") permits the installation of utility services or other products underground in an essentially trenchless manner, eliminating surface disruption along the length of the project and reducing the likelihood of damaging previously buried products. The typical HDD borepath begins from the ground surface as an inclined segment that is gradually leveled off as the desired product installation depth is neared. This depth is maintained—or a near horizontal path may be desirable instead—for the specified length of the product installation. The presence of previously buried products has given rise to a need for methods and systems that allow for steering of a boring tool as it moves along the borepath.

To steer the boring tool, it is important to know the location and orientation (roll, pitch and yaw) of the downhole tool assembly. Various beacon assemblies have been developed to provide the operator with information concerning the location and orientation of the downhole tool assembly. To provide accurate location and orientation information it is important that the beacon assembly is properly calibrated and configured.

The present invention provides the ability to configure certain and various operation parameters of the beacon assembly so that the downhole tool assembly may be located and steered during the boring operation. The present invention provides the ability to configure the orientation of the beacon assembly to match the orientation of the downhole tool assembly without concern for the actual orientation of the beacon assembly supported within the downhole tool assembly or with the type of connection between the boring tool and the tool assembly. With the present invention, the orientation of the receiver may be electronically adjusted without the need for removing the boring tool from the housing or repositioning the orientation sensors within the housing of the tool assembly. Additionally, various other beacon assembly operation parameters may be electronically configured i.e., intensity or signal strength of the magnetic field, orientation sensor resolution, transmitted frequency, and the rate at which data is transmitted from the beacon assembly. While the preferred application of this invention is to near surface HDD, the systems and methods of this invention may be applied to other machines and devices which require knowing the orientation and location of a device.

Figure 1:
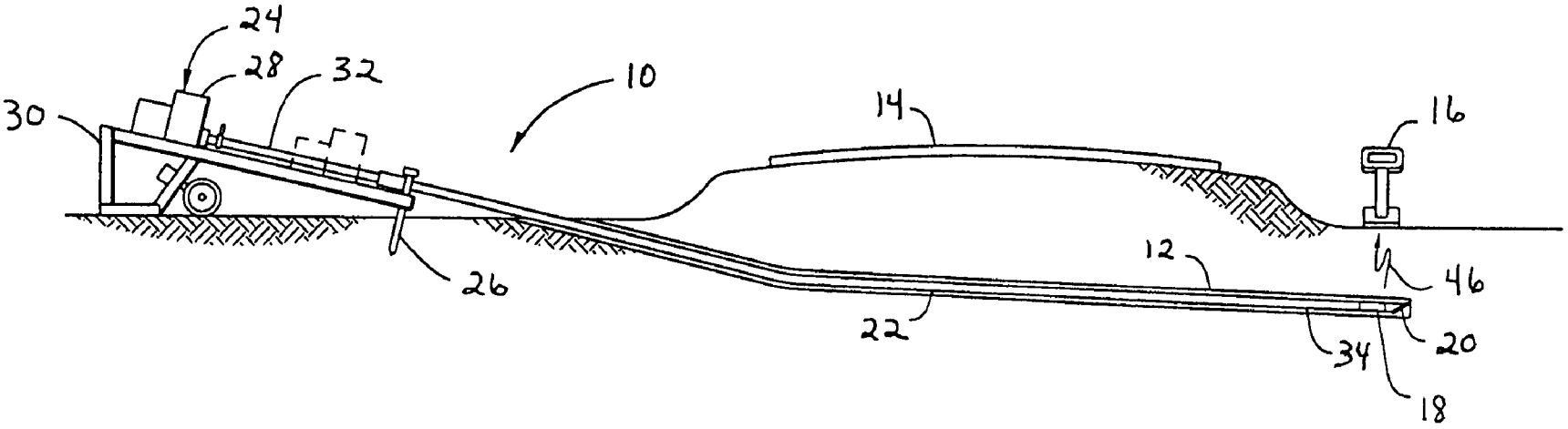
FIG. 1 is a diagrammatic representation of a horizontal directional drilling system having a machine that acts on an uphole end of a drill string. The drill string supports a downhole tool assembly having a beacon assembly supported thereon.
Figure 4:
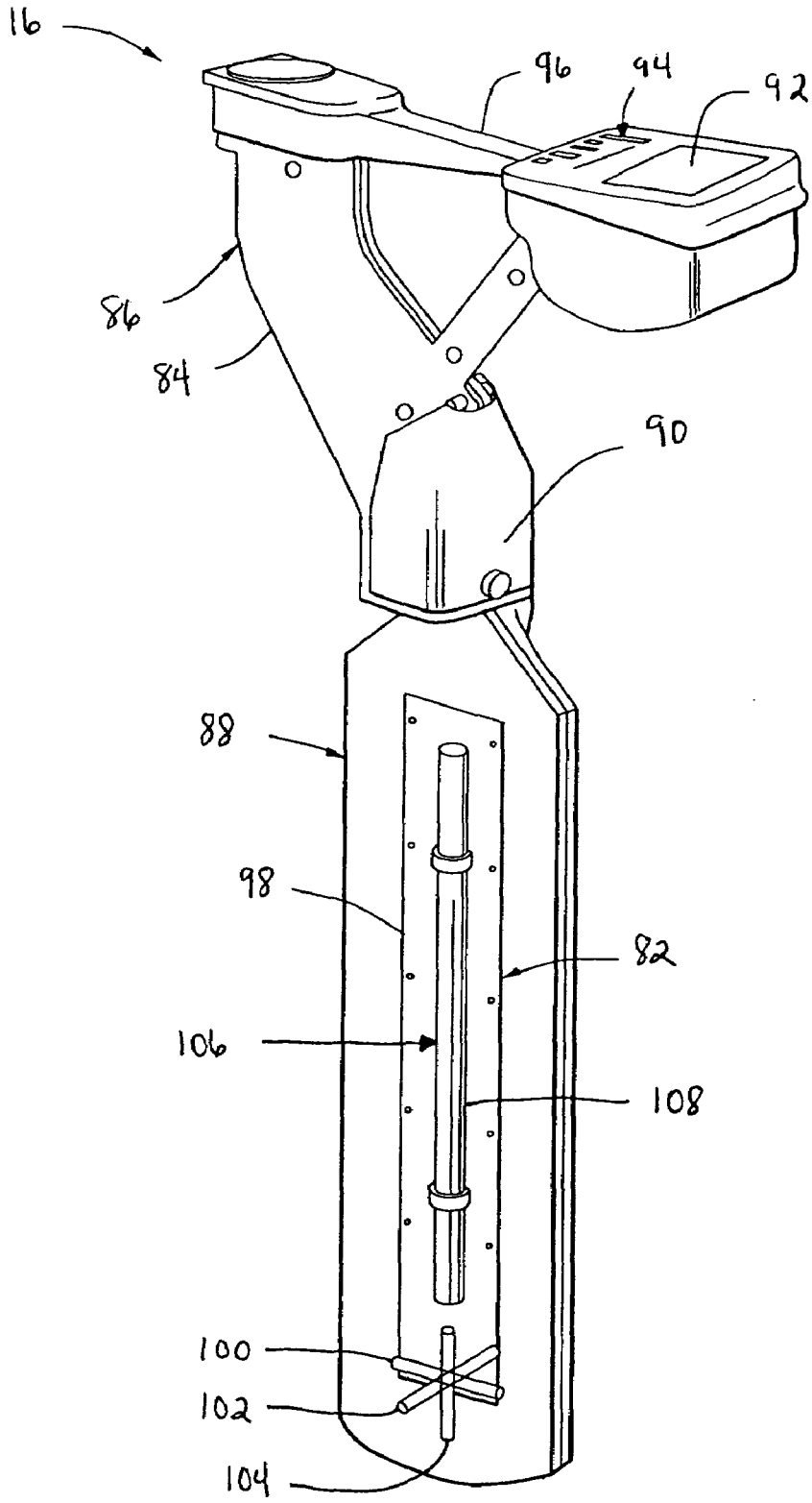
FIG. 4 is a perspective view of a monitoring system constructed in accordance with the present invention and used to monitor the location and orientation of the downhole tool assembly. The monitoring system of FIG. 4 is shown with a transmitting assembly having a transmitter that emits an operation instruction signal.

With reference now to the drawings in general and FIG. 1 in particular, there is shown therein a HDD system 10 suitable for the subsurface placement of utility services. FIG. 1 illustrates the usefulness of near surface HDD by illustrating that a borehole 12 can be made without disturbing an above-ground structure, namely the roadway as denoted by reference numeral 14. FIG. 1 also illustrates the present invention by showing the use of a monitoring system 16 to monitor the location and orientation of a downhole tool assembly 18, comprising a directional boring tool 20, supported on a drill string 22. The monitoring system 16 may include a transmitting assembly, as shown in FIG. 4, that comprises a transmitter adapted to transmit at least an operation instruction signal. As used herein, directional boring tool 20 is intended to refer to any drilling bit or boring tool which may cause deviation of the tool from a straight path. A directional boring tool, when operated in accordance with the present invention, will have a steering capability to enable the downhole tool assembly 18 to direct the path of the borehole 12.

Referring still to FIG. 1, the HDD system 10 generally comprises an HDD machine 24, the drill string 22, the monitoring system 16, the downhole tool assembly 18, and an earth anchor 26. The HDD machine 24 comprises a rotary drive system 28 movably supported on a frame 30 between a first position and a second position. Movement of the rotary drive system 28 by way of an axial advancement means (not shown) between the first position and the second position, axially advances the drill string 22, downhole tool assembly 18, and directional boring tool 20 through the earth to create the borehole 12. The earth anchor 26 is driven into the earth to stabilize the frame 30 against the axial force exerted by the movement of the axial advancement means during the axial advancement of the downhole tool assembly 18 and directional boring tool 20.

The drill string 22 is operatively connected to the rotary drive system 28 of the HDD machine 24 at a first end 32. The downhole tool assembly 18 is operatively connected to a downhole second end 34 of the drill string 22. The drill string 22 transmits torque and thrust to the downhole tool assembly 18 and directional boring tool 20 to drill the subsurface borehole 12.

Figure 2:
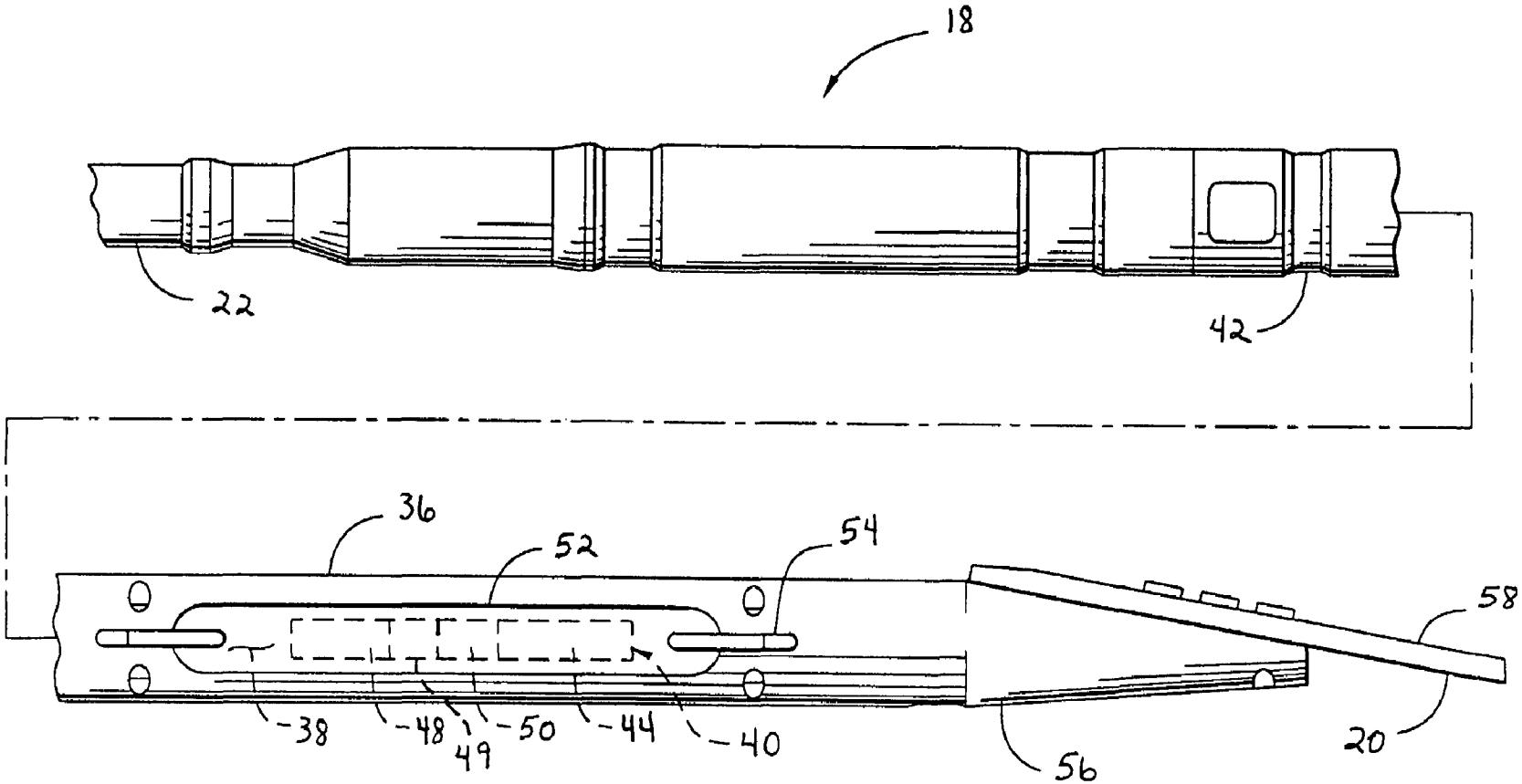
FIG. 2 is a side elevational view of a downhole tool assembly. The downhole tool assembly is shown supporting a boring tool and a beacon assembly used in the present invention.

Turning now to FIG. 2, there is shown therein the downhole tool assembly 18 constructed in accordance with the present invention. The downhole tool assembly 18 comprises a housing 36 and the directional boring tool 20. The housing 36 comprises a chamber 38 for supporting the beacon assembly 40. The housing 36 is operably connected at a rear end 42 to the drill string 22. Preferably, the connection between the rear end 42 of the housing 36 and the drill string 22 is a threaded connection.

As discussed above, the beacon assembly 40 is supported by the downhole tool assembly 18 and comprises at least a configurable operation parameter. Further, the beacon assembly 40 may comprise an electromagnetic transmitter 44 that emits an output signal 46 (FIG. 1) that may be a magnetic field that is modulated to communicate information indicative of the location, orientation, and condition of the beacon assembly 40. Preferably, a beacon assembly 40 for use with the present invention will also include a receiver 49 supported by the beacon assembly and adapted to detect the operation instruction signal from the transmitting assembly. The receiver 49 is also adapted to communicate the detected operation instruction signal to a processor 50.

The processor 50 is supported by the beacon assembly 40 and is adapted to receive the detected operation instruction signal from the receiver 49 and to configure the operation parameter of the beacon assembly. Further, the processor 50 can attach orientation information received from the orientation sensor 48, by well-known amplitude, phase, or frequency modulation techniques, onto an output signal 46 (FIG. 1) transmitted by the electromagnetic transmitter 44 to the monitoring system 16 (shown in FIG. 1). The signal 46 is processed by the monitoring system 16 to determine the location and orientation of the downhole tool assembly 18 and condition of the beacon assembly 40.

As shown in FIG. 2, the housing 36 has a side-entry opening 52 to receive the beacon assembly 40, which is held therein by a retaining cover 54. It should be noted that a front-loading or end-loading housing could also be utilized without departing from the spirit of the invention. The beacon assembly 40 could also be an integral part of the housing 36. Preferably, the beacon assembly 40 and orientation sensors 48 are maintained in substantially parallel axial alignment with respect to the central axis of the housing 36. Beacon assemblies and associated internal orientation sensors suitable for use with the present invention are disclosed in U.S. Pat. No. 5,264,795, issued to Rider, U.S. Pat. No. 5,703,484, issued to Bieberdorf, et al., U.S. Pat. No. 5,850,624, issued to Gard, et al., and U.S. Pat. No. 5,880,680, issued to Wisehart, et al., the contents of which are incorporated herein by reference.

The directional boring tool 20 is attached to the front end 56 of the housing 36. As shown in the embodiment of FIG. 2, the front end 56 of the housing 36 may be configured for the attachment of a boring tool comprising a flat blade drill bit 58. Preferably, the flat blade drill bit 58 is bolted onto the housing 36 at an acute angle of approximately 10° to the central axis of the housing 36. While the flat blade drill bit 58 is shown herein, it should be noted that any other directional boring tool or mechanisms which may cause deviation of the drill string may be used with the present invention. Such boring tools and mechanisms include single roller cone bits, carbide studded cobble drilling bits, replaceable tooth rock drilling bits, and bent-sub assemblies. Directional boring tools and mechanisms suitable for use with the present invention are described in U.S. Pat. No. 5,490,569 issued to Brotherton et al., U.S. Pat. No. 5,799,740, issued to Stephenson, et al., U.S. Pat. No. 6,109,371, issued to Kinnan, and U.S. Pat. No. 6,311,790, issued to Beckwith et al., the contents of which are incorporated herein by reference.

Figure 3:
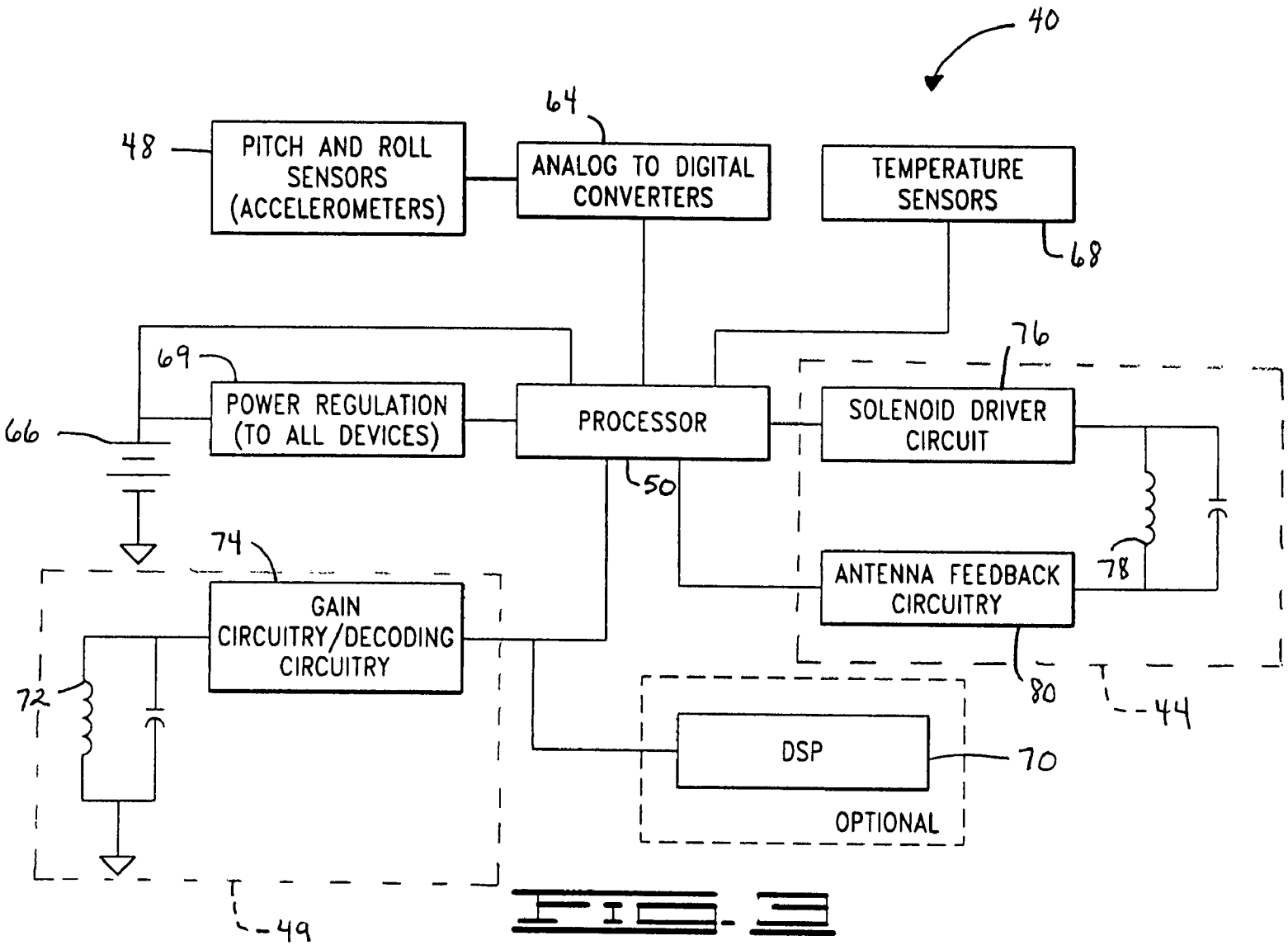
FIG. 3 is a block diagram of the beacon assembly shown in FIG. 2 illustrating the preferred hardware used to transmit an output signal and to detect and process operation instruction signals transmitted from a transmitting assembly.

Turning now to FIG. 3, the beacon assembly 40 constructed in accordance with the present invention is shown therein. The beacon assembly 40 comprises the receiver 49, the processor 50, and the electromagnetic transmitter 44. Additionally, the beacon system may comprise an orientation sensor 48, an analog to digital ("A/D") converter 64, a temperature sensor 68, a battery condition sensor (not shown), and an optional Digital Signal Processor 70. A power supply 66 and power regulator 69 are provided to normalize the voltage input into the various beacon assembly components.

The orientation sensor 48 may comprise one or more accelerometers adapted to sample changes in the angular orientation of the beacon assembly 40. For example, the orientation sensor 48 may comprise pitch or roll sensors that are capable of sampling data indicative of the pitch and roll orientation of the beacon assembly 40. A pitch sensor is generally aligned so that its sensitive axis is parallel to and coaxial with the longitudinal axis of the beacon assembly 40. Placing the pitch sensor in this orientation provides the greatest sensitivity to changes in the pitch orientation of the beacon assembly while minimizing the effect of changes in roll orientation. Additionally, the orientation sensor 48 may also comprise a magnetometer or similar device for sensing the azimuth of the housing 36. Preferably, the orientation sensor 48 will be operable alternatively in a low resolution mode or a high resolution mode.

The orientation data is sent from the orientation sensor 48 to the A/D converter 64. The A/D converter 64 takes the analog data received from the orientation sensor 48 and converts it into a digital format for use by the processor 50. It will be appreciated that an orientation sensor that outputs digital data directly to the processor 50 may be used in accordance with the present invention.

The temperature sensor 68 is provided to monitor the temperature of the beacon assembly 40 and transmit the results of temperature readings to the processor 50 in a temperature signal. In the event that the temperature readings transmitted from the temperature sensor 68 exceed safe operating parameters, the processor 50 is programmed to turn off the beacon assembly 40 and its associated electronics.

The processor 50 contains the programming and memory required to use the raw data from the orientation sensor 48 and the temperature sensor 68 to determine the spatial orientation of the beacon assembly 40. The processor 50 processes the data, performs any necessary calculations and corrections, and communicates the results to the transmitter 44.

The processor 50 applies filtering to the orientation data received from the orientation sensor 48. Filtering is used so that the orientation can be measured effectively while the downhole tool assembly 18 (FIG. 2) is rotating. Filtering reduces vibration noise and other electrical noise and provides a clean signal to the transmitter 44.

The electromagnetic transmitter 44 is coupled to the processor 50 for encoding orientation, temperature, and battery condition information on a carrier for transmitting to the monitoring system 16 in a known manner. The transmitter 44 may comprise a solenoid driver circuit 76, a transmitting solenoid 78, and an antenna feedback circuitry 80 as described in U.S. Pat. No. 5,872,703, the contents of which are incorporated herein by reference. The solenoid driver circuit drives operation of the transmitting solenoid. The transmitting solenoid is adapted to emit a carrier signal that is capable of communicating orientation, signal strength, temperature information, and battery condition to the monitoring system 16. The antenna feedback circuitry normalizes the signal strength of the transmitter's 44 output signal so that the downhole tool assembly 18 may be properly located using the monitoring system 16.

The receiver 49 is supported by the beacon assembly 40 and adapted to detect an operation instruction signal from a transmitting assembly (discussed hereinafter) and to communicate the detected operation instruction signal to the processor 50. The receiver 49 may comprise an antenna assembly 72 comprising at least one ferrite core receiving antenna. The antenna assembly 72, as previously discussed, detects the operation instruction signals emanating from the transmitting assembly 106 (FIG. 4). The antenna assembly 72 may also provide initial amplification and conditioning of the detected operation instruction signals using gain and decoding circuitry 74 known to one skilled in the art.

Turning now to FIG. 4, there is shown therein an embodiment of the monitoring system 16 of the present invention. The monitoring system 16 is adapted to monitor the location and orientation of the downhole tool assembly 18 (shown in FIGS. 1 & 2) by detecting the output signal 46. The monitoring system 16 of FIG. 4 comprises a receiver antenna assembly 82 adapted to detect the output signal 46 from the electromagnetic transmitter 44 and to communicate the detected signal to a yet to be described monitoring system processor. In FIG. 4, the monitoring system is shown to have a frame 84 comprising a handheld unit having an upper portion 86 and a lower portion 88.

The upper portion 86 includes a battery compartment 90, a visual display 92, an input assembly 94 for inputting predetermined operation parameters into the monitoring system 16, and a handle 96 for carrying the monitoring system. The battery compartment 90 is used to secure a power supply within the frame 84 during operation of the monitoring system 16. The visual display 92, such as a liquid crystal display, is adapted to visually communicate various operational parameters to the operator (not shown), including the orientation of the downhole tool assembly 18.

The antenna assembly 82 is adapted to detect the output signal 46 (FIG. 1) transmitted by the beacon assembly 40 (shown in FIGS. 2 and 3) and to communicate the detected signals to a processor. The antenna assembly 82 may comprise a plurality of antennas operatively connected to a circuit board 98 and adapted to detect the output signal 46 transmitted from the beacon assembly 40. Antennas 100, 102, and 104 are shown to illustrate one possible antenna configuration capable of detecting the output signal 46 transmitted by the beacon assembly 40. Antennas 100, 102, and 104 may individually comprise antennas with center-tapped coils including a ferrite rod to increase the magnetic flux through the coil. Antennas suitable for use with the present invention are described in U.S. Pat. No. 5,264,795, issued to Rider, the contents of which are incorporated by reference herein. Alternatively, air cored antennas would also be suitable for use with the present invention.

The monitoring system 16 may also comprise a transmitting assembly 106 supported on the frame 84 of the monitoring system 16. The transmitting assembly 106 may comprise a transmitting antenna 108 that is adapted to transmit the operation instruction signal to the receiver 49 (FIG. 3). The transmitting antenna 108 may comprise a coil wound on a ferrite rod. The transmitting antenna 108 is coupled to a yet to be described transmitting assembly processor that generates operation instruction signals that are transmitted to the receiver 49.

Figure 5:
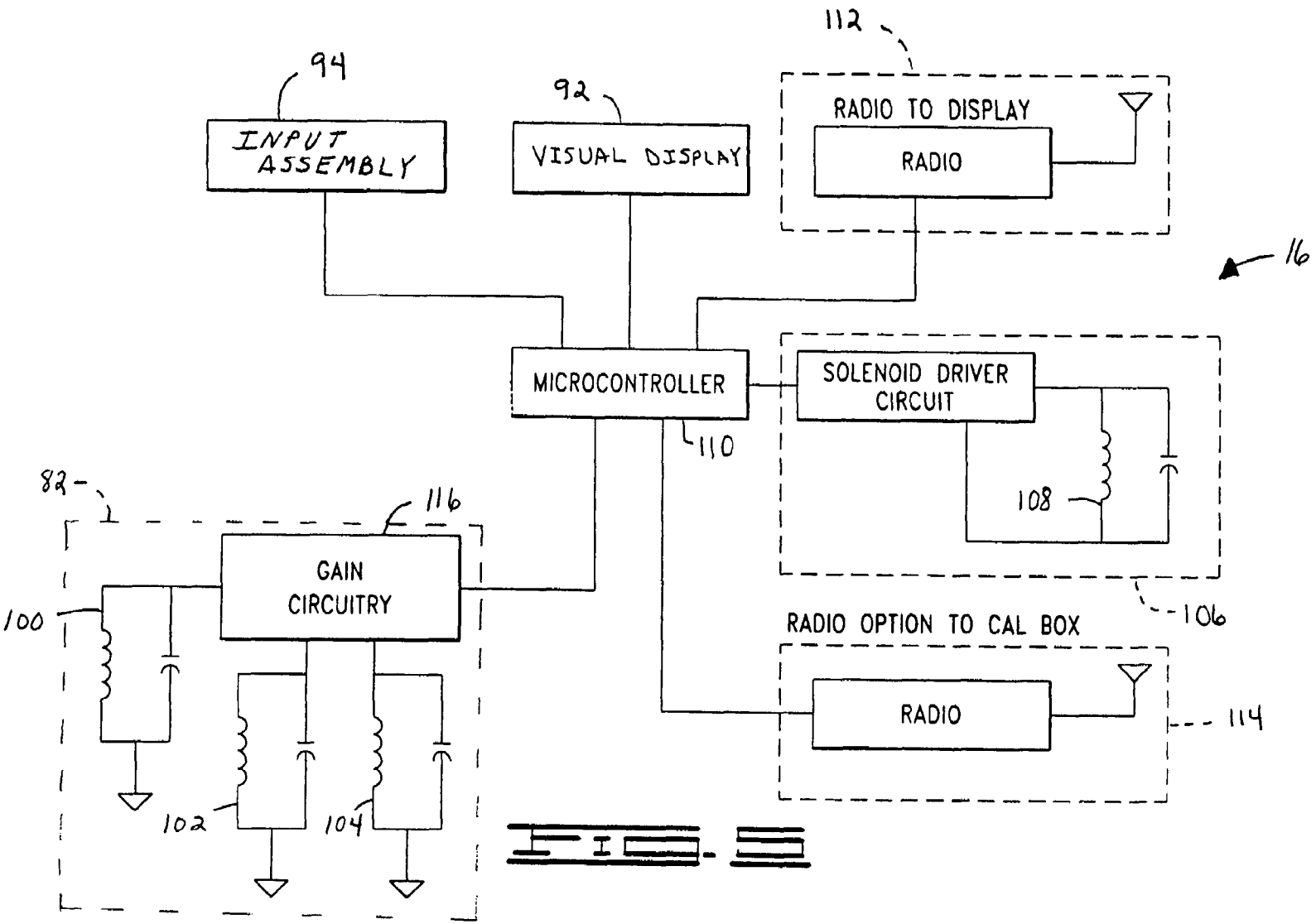
FIG. 5 is a block diagram illustrating the preferred hardware comprising the monitoring system of FIG. 4. The monitoring system is constructed to detect and process signals transmitted from the beacon assembly.

With reference now to FIG. 5, a block diagram of the components comprising the monitoring system 16 are shown therein. As previously discussed, the monitoring system 16 comprises the antenna assembly 82, the visual display 92, the input assembly 94, the transmitting assembly 106, and the monitoring system processor 110. Additionally, the monitoring system 16 may comprise a wireless communication system 112 that is capable of transmitting location and orientation information from the monitoring system 16 to a location distant from the monitoring system, such as to the HDD machine 24. The monitoring system 16 of FIG. 5 is shown with the transmitting assembly 106. However, it will be appreciated that the monitoring system 16 may be adapted to comprise a communications link 114 that is used to communicate with a transmitting assembly 106 A & B (FIGS. 6 & 10) that are separate from the monitoring system. As shown in FIG. 5, the communications link 114 may communicate with the separate transmitter assembly using radio communications.

The antenna assembly 82, as previously discussed, detects the output signal 46 (FIG. 1) emanating from the downhole tool assembly 18. The antenna assembly 82 may also provide initial amplification and conditioning of the detected signals using gain circuitry 116. The antenna assembly 82 is adapted to transmit the detected signals to the monitoring system processor 110.

The monitoring system processor 110 is programmed to control many of the monitoring system 16 functions and may also be programmed to cause the transmitter assembly 106 to send operation instruction signals to the receiver 49. For example, the processor 110 may be programmed to send an operation instruction signal to the receiver 49 that causes the intensity or signal strength of the output signal 46 to increase or decrease.

Figure 6:
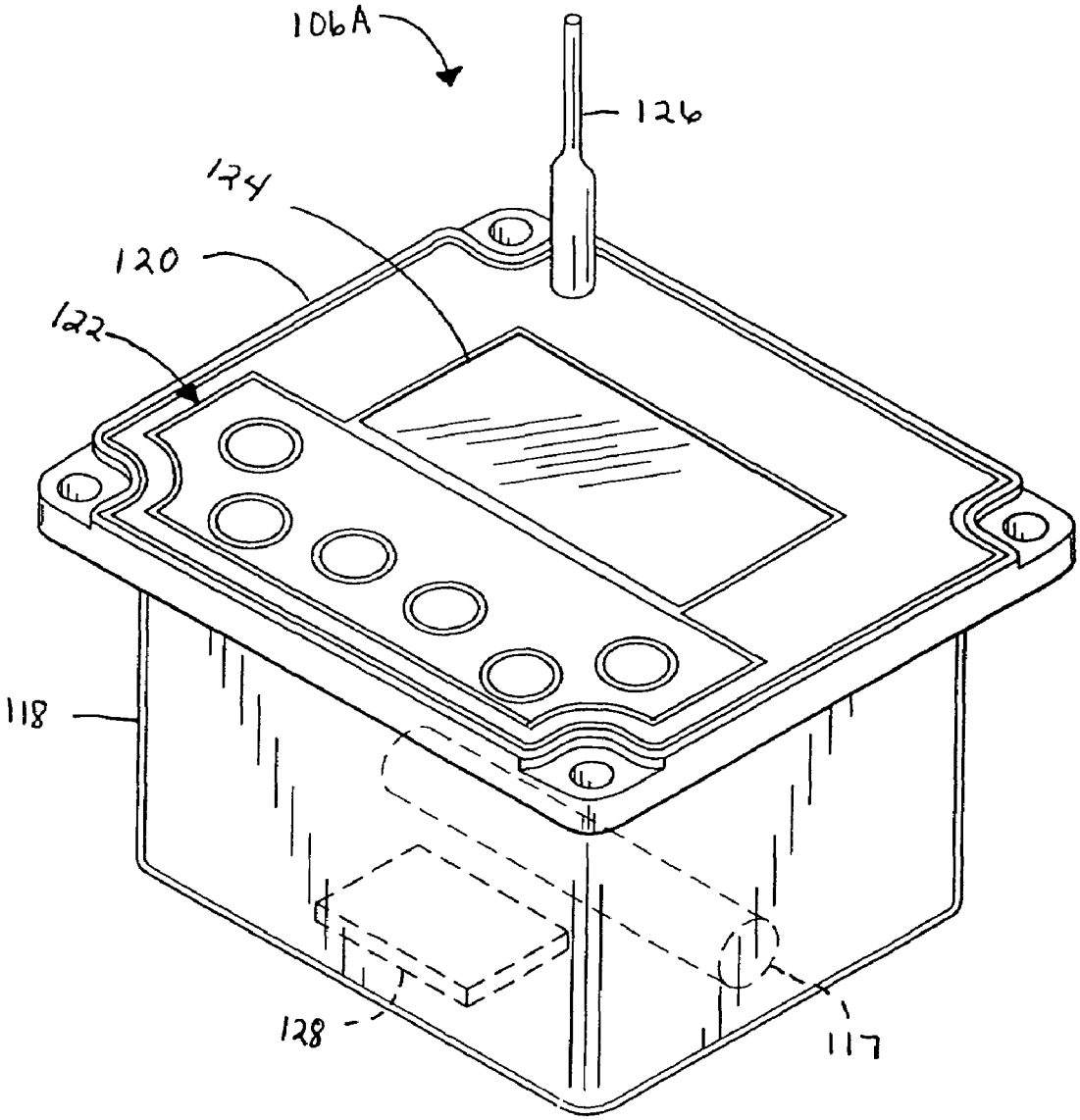
FIG. 6 is a perspective view of an alternative transmitting assembly constructed in accordance with the present invention.

Turning now to FIG. 6 there is illustrated therein an alternative transmitting assembly 106A that is separate from the monitoring system 16. The transmitting assembly 106A has a transmitter 117 adapted to transmit at least an operation instruction signal to the receiver 49 of the beacon assembly 40 (shown in FIGS. 2 & 3). The transmitting assembly 106A comprises a case 118 that is generally cubic and adapted to support the transmitter 117 and a face plate 120.

The face plate 120 supports an input assembly 122, a visual display 124, and a radio transceiver 126. The input assembly 122 is adapted to receive a predetermined operation parameter and to communicate the predetermined operation parameter data to the processor 128. The input assembly 122 may comprise a keypad that is coupled to the transmitting assembly processor 128. As used herein, predetermined operation parameter may comprise the signal strength of the output signal 46 (FIG. 1), offset and resolution of the orientation sensor 48, the frequency of the output signal, the rate at which data is transmitted from the beacon assembly 40 (FIGS. 2 and 3), and timed power down of the beacon assembly. The visual display 124 is used to communicate operation parameters and information received from the monitoring system 16 to the operator. The radio transceiver 126 may receive the predetermined operation parameters from the monitoring system 16 wireless communication system 112 and thus eliminate the need for the input assembly 122.

The transmitting assembly processor 128 is supported by the transmitting assembly case 118. The transmitting assembly processor 128 is programmed to receive the predetermined operation parameter data from the input assembly 122. The input assembly 122 communicates the operation parameter data to the transmitting assembly processor 128 which processes the predetermined operation parameter data to produce the operation instruction signal. The processor 128 can transmit the predetermined operation parameter in the form of an operation instruction signal using either the radio transceiver 126 or the input assembly 122.

Figure 7:
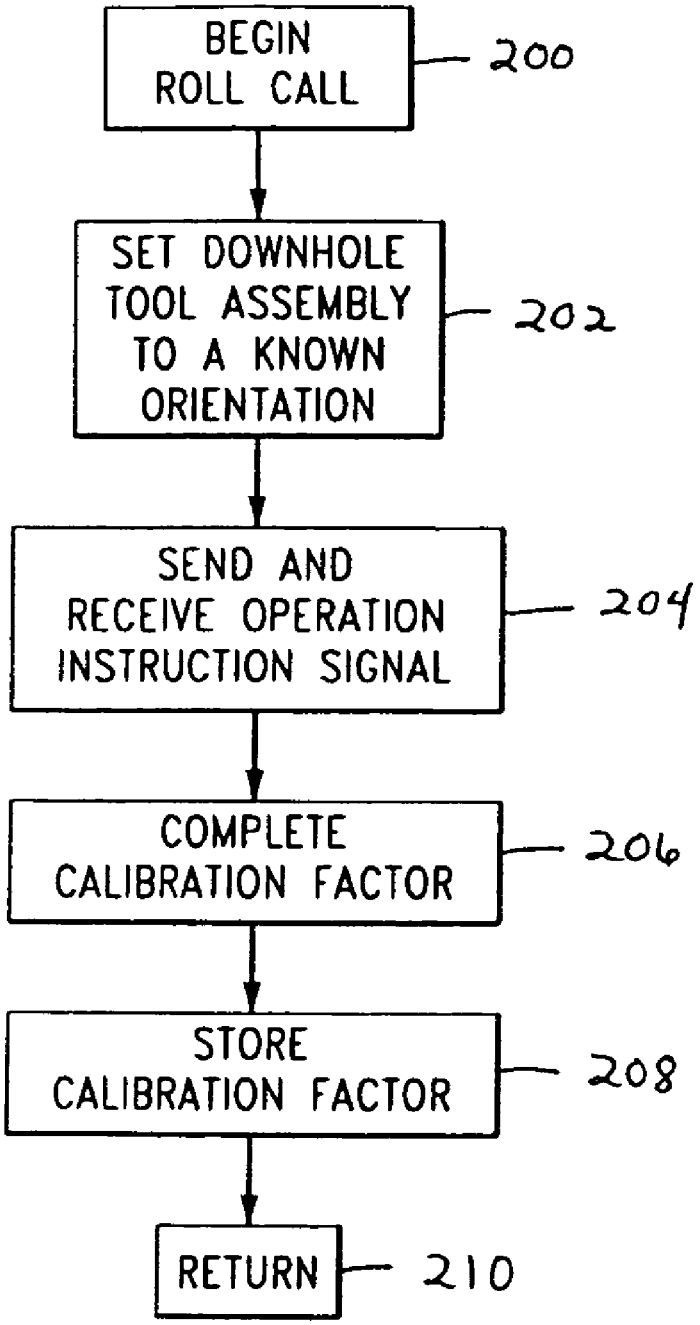
FIG. 7 is a flow chart illustrating a roll calibration routine used to determine a calibration factor indicative of the actual roll orientation of the beacon assembly relative to a known downhole tool assembly roll orientation.

Turning now to FIG. 7, a routine for predetermining a calibration factor indicative of the actual orientation of the beacon assembly 40 relative to a known downhole tool assembly 18 orientation is shown. The calibration factor is determined in response to the operation instruction signal sent from the transmitting assembly 106 and detected by the receiver 49. The detected operation instruction signal is processed according to the predetermined calibration factor to determine the actual orientation of the downhole tool assembly 18. The actual orientation of the downhole tool assembly 18 is determined by the processor 50 using the actual orientation of the receiver 49 and the calibration factor.

The calibration factor is indicative of the angle offset between the beacon assembly 40 and the downhole tool assembly 18. For purposes of illustration, the routine shown in FIG. 7 is used to calibrate the orientation sensor 48 comprising a roll sensor. The roll angle calibration routine is performed with the downhole tool assembly 18 (FIG. 2) at a known orientation. The orientation sensor 48 comprising the roll sensor (FIG. 2) transmits roll data to the beacon assembly processor 50.

The roll calibration begins (step 200), and the downhole tool assembly 18 is set to a known orientation (step 202). Preferably, the downhole tool assembly 18 is set so that the directional boring tool 20 orientation corresponds to a desired steering position. Typically, the desired position is with the boring tool oriented to cause the drill string to move in an upward direction, normally referred to as zero (0) degrees, or the twelve (12) o'clock position. However, it will be appreciated that the boring tool 20 and downhole tool assembly may be set at any other known orientation.

With the downhole tool assembly 18 at the known orientation, the transmitting assembly 106 transmits the operation instruction signal to the receiver 49 (step 204). During the roll calibration routine the operation instruction signal comprises a command from the transmitter assembly 106 to adjust the orientation information output from the processor 50 to the known roll orientation. The roll data communicated to the beacon assembly processor 50 contains the actual roll orientation of the roll sensor. The processor 50 assumes that the downhole tool assembly 18 has been set at a known reference orientation, as described above, and computes the calibration factor (step 206) as being equal to the offset of the roll orientation relative to the known orientation of the downhole tool assembly. The beacon assembly processor 50 then stores the calibration factor in memory (step 208) and the roll calibration is ended (step 210).

Figure 8:
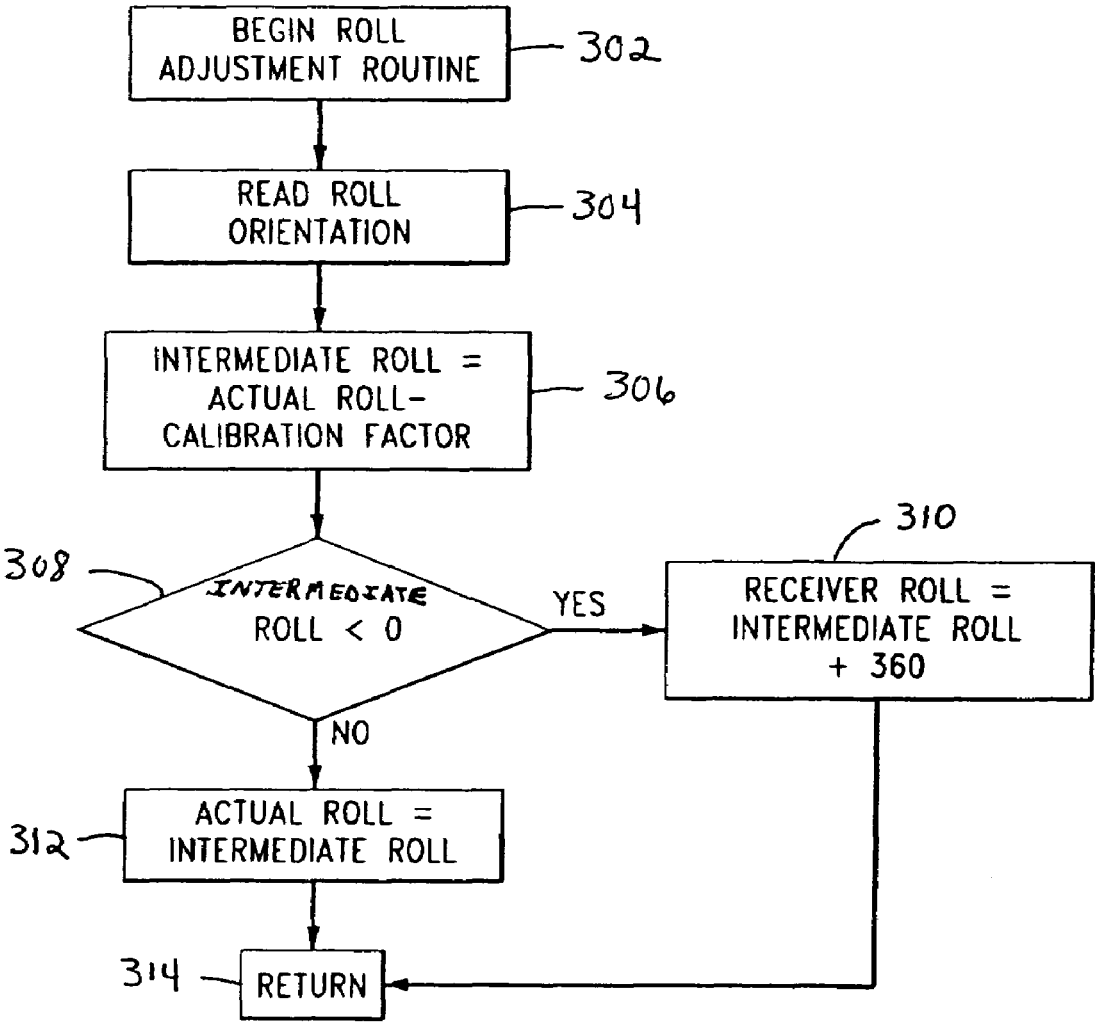
FIG. 8 is a flow chart illustrating a roll adjustment routine used to determine the actual roll orientation of the downhole tool assembly.
Figure 8:
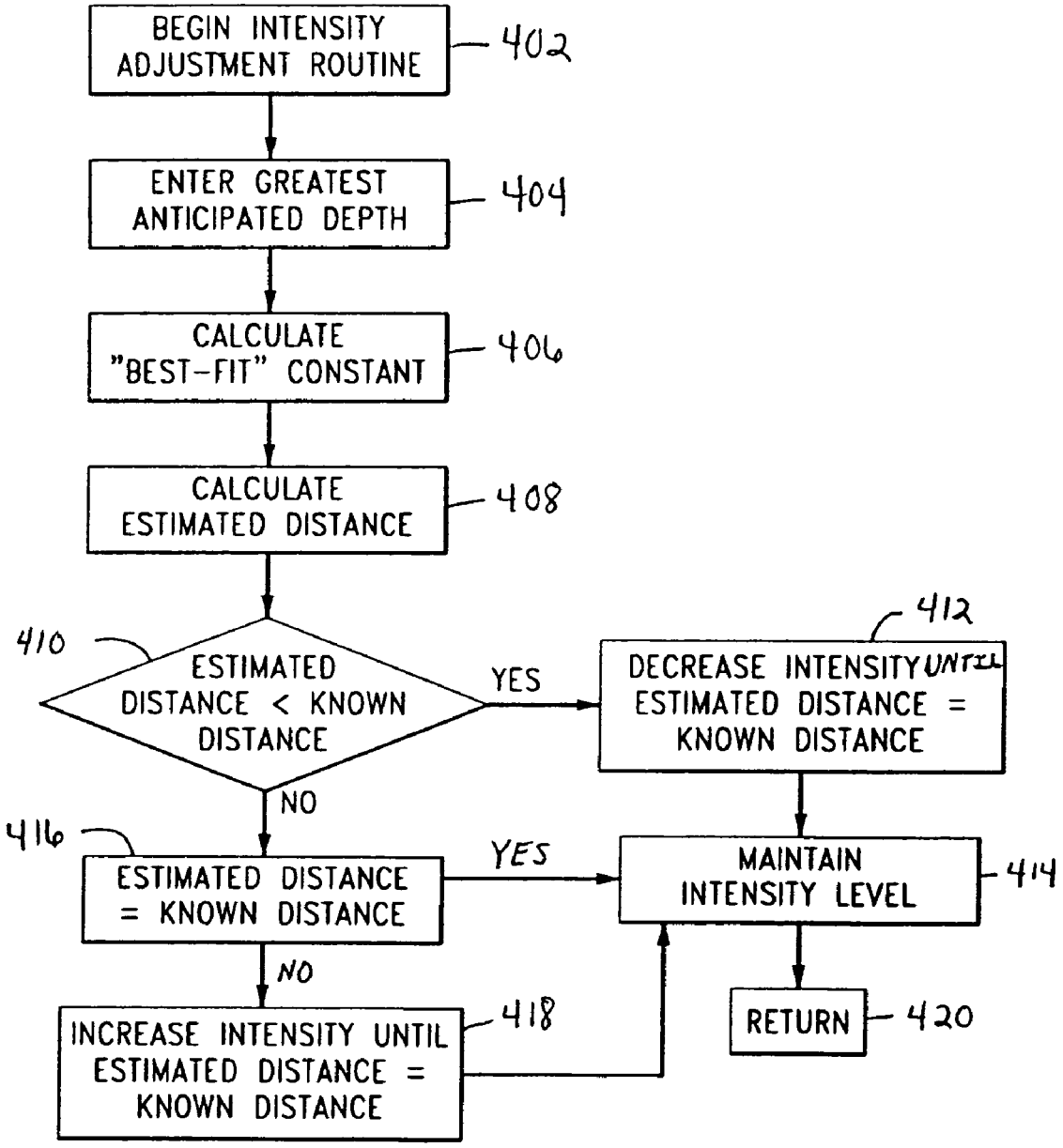

The stored calibration factor is then later accessed when the operator wishes to determine the actual orientation of the downhole tool assembly 18 by performing a roll adjustment routine. The roll adjustment routine of the beacon assembly 40 is illustrated in FIG. 8. When the roll adjustment routine is implemented (step 302), the roll sensor samples the roll orientation of the beacon assembly 40 and communicates the roll orientation data to the beacon assembly processor 50 (step 304). The processor 50 reads the orientation data from the roll orientation sensor to determine the actual orientation of the beacon assembly 40. The stored calibration factor is then subtracted from the actual orientation of the beacon assembly 40 to get an intermediate roll value for the downhole tool assembly 18 (step 306).

The intermediate roll value is either a positive or a negative value, giving the intermediate roll value either a positive sign or a negative sign. If the intermediate roll value is less than zero (step 308), then the actual orientation of the downhole tool assembly is equal to the intermediate roll plus three hundred and sixty degrees (360°) (step 310). If the intermediate roll value is not less than zero (step 308), then the actual orientation of the downhole tool assembly 18 is equal to the intermediate roll value (step 312). The roll adjustment routine is then complete (step 314) and the actual orientation of the downhole tool assembly 18 is communicated to the monitoring system 16 via the output signal 46.

While the above routines have been described with reference to the calibration of roll sensors, it will be appreciated that one of skill in the art may adjust the above routines for use with known pitch and yaw sensors used to measure the pitch and yaw orientation of the downhole tool assembly 18. An alternative method and apparatus for calibrating a beacon assembly is disclosed in pending U.S. patent application titled Electronically Calibrated Beacon for a Horizontal Directional Drilling Machine, Ser. No. 10/365,596, filed Feb. 12, 2003, assigned to The Charles Machine Works, Inc., the contents of which is incorporated herein by reference.

Turning now to FIG. 9, there is shown a routine that is followed to adjust the intensity or signal strength of the output signal 46 of the transmitter 44. Generally, the monitoring system 16 is calibrated to the output signal's 46 constant magnetic field strength by solving the following equation for "z":

$$H=z/d^3 \quad (1)$$

Where the variable "H" represents the strength of the magnetic field detected by the monitoring system antenna assembly 82 and "d" is the distance between the downhole tool assembly 18 and the monitoring system 16. The value for "z" is stored by the monitoring system 16 and used in subsequent measurements of the magnetic field to determine the distance between the downhole tool assembly 18 and the monitoring system.

The present invention is directed to a method and apparatus that is capable of configuring the signal strength of the output signal 46 to calibrate the beacon assembly 40. In a preferred method of configuring the signal strength of the output signal 46, the monitoring system 16 and downhole tool assembly are positioned a known distance, preferably ten (10) feet, from each other. The downhole tool assembly 18 supporting the beacon assembly 40 is manipulated at this distance until a maximum signal strength reading is shown on the monitoring system's visual display 92. Once the monitoring system 16 and downhole tool assembly 18 are properly positioned the signal strength adjustment routine may be implemented (step 402).

Using the input assembly 94 the operator may enter the greatest anticipated depth that the downhole tool assembly 18 will reach during the upcoming boring operation (step 404). Additionally, the operator may input the noise floor of the area in which the boring operation will be conducted. Based upon the anticipated depth and noise floor, the monitoring system processor 110 will calculate a predetermined calibration parameter. The predetermined calibration parameter may comprise a "best-fit" constant "z" for use in the above equation to make distance calculations (step 406).

Next, the antenna assembly 82 of the monitoring system 16 detects the signal strength of the output signal 46 transmitted from the beacon assembly transmitter 44 and communicates the detected signal to the monitoring system processor 110. The monitoring system processor 110 processes the signal strength of the output signal 46 "H", and calculates an estimated distance between the monitoring system 16 and the downhole tool assembly 18 using the best-fit constant "z" (step 408). The estimated distance between the monitoring system 16 and the downhole tool assembly 18 may be generally greater than the known distance or less than the known distance between the monitoring system and the downhole tool assembly (step 410).

If the estimated distance is less than the known distance the monitoring system processor 110 determines an output signal strength adjustment factor and communicates the adjustment factor to the transmitting assembly 106. The transmitting assembly 106 receives and processes the intensity adjustment factor and generates an operation instruction signal that is transmitted to the receiver 49. The operation instruction signal is generally indicative of the estimated distance between the downhole tool assembly 18 and the monitoring system 16. The beacon assembly processor 50 receives the operation instruction signal and decreases the strength of the output signal (step 412). The process is repeated until the estimated distance is substantially equal to the known distance between the downhole tool assembly 18 and the monitoring system 16. Once the estimated distance and known distance are substantially equal, the transmitting assembly 106 transmits an operation instruction signal to the beacon assembly instructing the beacon assembly to maintain the proper strength until instructed otherwise (step 414).

If the estimated distance is not less than the known distance, but the two are not equal (step 416), the transmitting assembly 106 transmits and operation instruction signal to the beacon assembly 40 instructing the beacon assembly to increase the strength of the output signal 46 (step 418). The instruction is repeated until the estimated distance is substantially equal to the known distance between the downhole tool assembly 18 and the monitoring system 16. Once the estimated distance and known distance are substantially equal, the transmitting assembly 106 transmits an operation instruction signal to the beacon assembly instructing the beacon assembly to maintain the proper strength until instructed otherwise (step 414). However, if at Step 416 the estimated distance and the known distance are substantially equal, the maintain signal strength operation instruction signal is sent to the beacon assembly 40 without requiring the step of increasing the strength. The output signal strength adjustment routine is then ended and the distance thereafter calculated by the monitoring system processor 110 is indicative of the actual distance between the monitoring system 16 and the downhole tool assembly 18.

Figure 10:
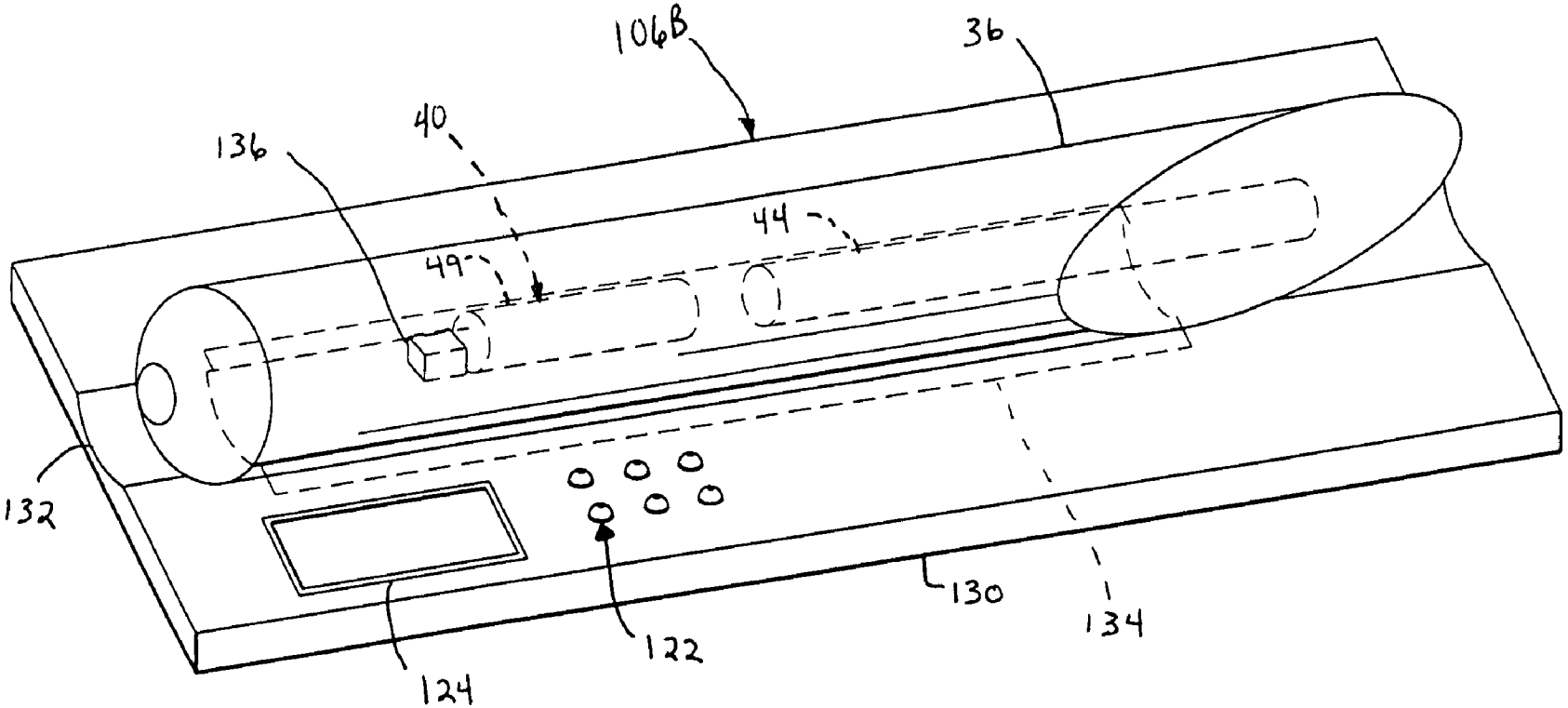
FIG. 10 illustrates yet another alternative transmitting assembly that transmits operation instruction signals to the beacon assembly via a direct connection with the downhole tool assembly housing.

Turning now to FIG. 10 there is shown therein a diagrammatic representation of an alternative transmitting assembly 106B that is adapted to directly connect the beacon assembly 40 to the transmitting assembly through the housing 36. Transmitting assembly 106B comprises a base 130 having a generally elongate v-groove or concave groove 132 for supporting the housing 36. The base also supports the visual display 124, input assembly 122, and associated electronics discussed with reference to transmitting assemblies 106 and 106A of FIGS. 5 and 6. The transmitter 134 of transmitting assembly 106B is supported within the groove 132 and adapted to transmit operation instruction signals to the beacon assembly 40. Accordingly, the beacon assembly 40 shown in FIG. 10 comprises the receiver 49, the transmitter 44 and electronics 136 that are electrically connected to the housing 36. The electronics 136 are adapted to receive operation instruction signals transmitted through the housing 36 and communicate the signals to the beacon assembly 40. The present embodiment is advantageous because the transmitting assembly 106B may transmit data to the beacon assembly 40 at a high rate.

The present invention also comprises a method for monitoring the location and orientation of the downhole tool assembly 18. In accordance with the method of the present invention, the location and orientation of the downhole tool assembly 18 is monitored using the monitoring system 16. The downhole tool assembly 18 has a beacon assembly 40 that comprises one or more of the configurable operation parameters described above.

The beacon assembly 40 transmits an output signal 46 indicative of one or more to the configurable operation parameters to the antenna assembly 82 of the monitoring system 16. The detected output signal may be processed to determine a value for the configurable operation parameter by either the monitoring system processor 110 or by the transmitting assembly processor 128 (FIG. 6). Using the determined value of the configurable operation parameter, the transmitting assembly transmits an operation instruction signal to the beacon assembly 40 to alter the configurable operation parameter of the beacon assembly. The beacon assembly 40 receives the operation instruction signal and processes it to alter the configurable operation parameter. The configured operation parameter is then maintained by the beacon assembly 40 until a new operation instruction signal is received by the beacon assembly.

The present invention also comprises a method for calibrating and determining the distance between the downhole tool assembly 18 and the monitoring system 16. The method comprises positioning the downhole tool assembly 18 and monitoring system 16 a known distance apart and at known orientations relative to each other. The downhole tool assembly 18 comprises the beacon assembly 40 that is adapted to transmit a magnetic field output signal.

The monitoring system 16 may comprise an antenna assembly 82 and processor 110 that are capable of detecting the signal strength of the magnetic field transmitted from the beacon assembly 40. The processor 110 calculates an estimated distance between the monitoring system 16 and the downhole tool assembly 18 based upon the detected signal strength of the magnetic field.

Based upon the relationship between the estimated distance and the known distance between the downhole tool assembly 18 and the monitoring system 16, an operation instruction is transmitted to the beacon assembly 40. In response to operation instructions, the beacon assembly 40 changes the signal strength of the magnetic field until the known distance between the monitoring system 16 and the downhole tool assembly 18 is substantially equal to the estimated distance calculated by the monitoring system processor 10. The monitoring system 16 can then be used at unknown distances from the downhole tool assembly 18 to calculate the distance from the monitoring system to the tool assembly based on the signal strength detected by the monitoring system.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A horizontal directional drilling system comprising:

a horizontal directional drilling machine;

a drill string operatively connected to the horizontal directional drilling machine;

a downhole tool assembly supported on the drill string;

a transmitting assembly comprising a transmitter adapted to transmit at least an operation instruction signal; and a beacon assembly supported by the downhole tool assembly comprising at least a configurable operation parameter, the beacon assembly further comprising:

a receiver supported by the beacon assembly and adapted to detect the operation instruction signal from the transmitting assembly and to communicate the detected operation instruction signal;

a processor supported by the beacon assembly, adapted to receive the detected operation instruction signal from the receiver and to configure the operation parameter of the beacon assembly in response to the detected operation instruction signal;

a transmitter adapted to transmit an output signal; and an orientation sensor adapted to measure the actual orientation of the beacon assembly and to communicate data indicative of the actual orientation of the beacon assembly to the processor; wherein the configurable operation parameter comprises the orientation data transmitted by the transmitter;

wherein the processor is adapted to predetermine a calibration factor indicative of the actual orientation of the beacon assembly relative to a known downhole tool assembly orientation in response to the detected operation instruction signal from the receiver, to process the detected operation instruction signal according to the predetermined calibration factor, and to determine an actual orientation of the downhole tool assembly using the actual orientation of the beacon assembly and the calibration factor.

2. The horizontal directional drilling system of claim 1 wherein the configurable operation parameter further comprises the signal strength of the output signal transmitted from the beacon assembly.

3. The horizontal directional drilling system of claim 1 wherein the configurable operation parameter further comprises the transmitted frequency of the output signal.

4. The horizontal directional drilling system of claim 1 wherein the configurable operation parameter further comprises the rate at which data is transmitted from the beacon assembly.

5. The horizontal directional drilling system of claim 1 wherein the orientation sensor comprises a roll sensor.

6. The horizontal directional drilling system of claim 1 wherein the orientation sensor comprises a low resolution mode and a high resolution mode, and wherein the operation instruction signal causes the orientation sensor to switch between the low resolution and high resolution modes.

7. The horizontal directional drilling system of claim 1 wherein the transmitting assembly transmits the operation instruction signal using a magnetic field and wherein the receiver comprises an antenna arrangement adapted to detect the magnetic field.

8. The horizontal directional drilling system of claim 1 further comprising a monitoring system adapted to monitor the position and orientation of the downhole tool assembly, the monitoring system comprising:

an antenna assembly adapted to detect the strength of the output signal from the transmitter and to communicate the detected signal strength;

a monitoring system processor adapted to receive the detected signal strength of the output signal, to process the detected signal strength value using the predetermined calibration parameter, and to determine an output signal intensity adjustment factor; and a monitoring system transmitter adapted to transmit the output signal intensity adjustment factor to the transmitting assembly.

9. The horizontal directional drilling system of claim 1 wherein the transmitting assembly further comprises:

an input assembly adapted to receive a predetermined operation parameter and to communicate the predetermined operation parameter; and a transmitting assembly processor supported by the transmitting assembly to receive the predetermined operation parameter from the input assembly, to process the predetermined operation parameter and to produce the operation instruction signal.

10. The horizontal directional drilling system of claim 1 further comprising a monitoring system adapted to monitor the location of the downhole tool assembly, wherein the transmitting assembly is supported by the monitoring system the monitoring system comprising:

an antenna assembly adapted to detect the output signal transmitted from the beacon assembly and to communicate the detected output signal; and a processor assembly adapted to receive the detected signal from the antenna assembly, to process the detected output signal to determine the distance between the downhole tool assembly and the monitoring system.

11. The horizontally directional drilling system of claim 1 wherein the receiver comprises an antenna assembly adapted to detect the operation instruction signal from the transmitting assembly and to communicate the detected operation instruction signal to the processor.

12. A beacon assembly having at least a configurable operation parameter for use with a horizontal directional drilling system having a transmitting assembly, the transmitting assembly comprising a transmitter adapted to transmit an operation instruction signal, the beacon assembly comprising;

a receiver adapted to detect the operation instruction signal from the transmitting assembly and to communicate the detected operation instruction signal;

a processor adapted to receive the detected operation instruction signal from the receiver, to process the operation instruction signal, and to configure the operation parameter of the beacon assembly in response to the detected operation instruction signal; and a transmitter for transmitting an output signal;

an orientation sensor adapted to measure the actual orientation of the beacon assembly and to communicate data indicative of the actual orientation of the beacon assembly to the processor and wherein the configurable operation parameter comprises the orientation data produced by the orientation sensor; and wherein the processor is adapted to predetermine a calibration factor indicative of the actual orientation of the beacon assembly relative to a known downhole tool assembly orientation in response to the detected operation instruction signal from the receiver, to process the detected operation instruction signal according to the predetermined calibration factor, and to determine an actual orientation of the downhole tool assembly using the actual orientation of the beacon assembly and the calibration factor.

13. The beacon assembly of claim 12 wherein the configurable operation parameter further comprises the signal strength of the output signal transmitted from the beacon assembly.

14. The beacon assembly of claim 12 wherein the configurable operation parameter further comprises the transmitted frequency of the output signal.

15. The beacon assembly of claim 12 wherein the configurable operation parameter further comprises the rate at which data is transmitted from the beacon assembly.

16. The beacon assembly of claim 12 wherein the orientation sensor comprises a roll sensor.

17. The beacon assembly of claim 12 wherein the orientation sensor comprises a low resolution mode and a high resolution mode, and wherein the operation instruction signal causes the orientation sensor to switch between the low resolution and high resolution modes.

18. The beacon assembly of claim 12 wherein the transmitting assembly transmits the operation instruction signal using a magnetic field and wherein the receiver comprises an antenna arrangement adapted to detect the magnetic field.

19. The beacon assembly of claim 12 wherein the receiver comprises an antenna assembly adapted to detect the operation instruction signal from the transmitting assembly and to communicate the detected operation instruction signal to the processor.

20. A method for monitoring the location and orientation of a downhole tool assembly using a monitoring system, the downhole tool assembly having a beacon assembly comprising at least one configurable operation parameter related to monitoring the location and orientation of the downhole tool assembly, the method comprising:

transmitting an output signal from the beacon assembly related to the at least one configurable operation parameter;

detecting the output signal;

processing the output signal to determine a value for the configurable operation parameter;

using the determined value, transmitting an operation instruction to the beacon assembly to alter the configurable operation parameter of the beacon assembly to obtain a desired value for the configurable operation parameter; and using the desired value for the configurable operation parameter to determine the location and/or orientation of the downhole tool assembly with the monitoring system.

21. The method of claim 20 wherein the configurable operation parameter comprises the strength of the output signal, the method comprising:

positioning the beacon assembly at a known orientation and at a known distance from the monitoring system;

measuring the strength of the output signal to determine an estimated distance between the downhole tool assembly and the monitoring system; and adjusting the strength of the output signal in response to the operation instruction so that the estimated distance measured by the monitoring system and the known distance between the monitoring system and the downhole tool assembly are substantially equal.

22. The method of claim 20 wherein the beacon assembly comprises an orientation sensor adapted to measure an orientation of the beacon assembly, wherein the orientation sensor is operable in a low resolution mode and a high resolution mode, and wherein the configurable operation parameter comprises resolution of the orientation sensor, the method comprising transmitting the operation instruction signal to the beacon assembly to switch the orientation sensor between the low resolution mode and the high resolution mode.

23. The method of claim 20 wherein the beacon assembly comprises an orientation sensor and a processor assembly, the method comprising:

positioning the downhole tool assembly at a known orientation with the beacon assembly supported therein;

transmitting the output signal from the beacon assembly, wherein the output signal contains beacon assembly orientation information;

processing the output signal to determine an orientation of the beacon assembly, to electronically determine a calibration factor corresponding to the difference between the known orientation of the downhole tool assembly and the orientation of the beacon assembly;

transmitting the operation instruction signal comprising the calibration factor to the beacon assembly; and processing the calibration factor to alter the output signal so that the orientation information contained on the output signal is indicative of an orientation of the downhole tool assembly.

24. The method of claim 23 further comprising displaying the orientation of the downhole tool assembly at the monitoring system.

25. The method of claim 23 further comprising monitoring changes in the orientation of the downhole tool assembly by calculating an orientation of the downhole tool assembly using the beacon assembly orientation information contained on the output signal and the calibration factor.

26. The method of claim 25 wherein the output signal of the beacon assembly comprises pitch angle data and roll angle data and wherein calculating the orientation of the downhole tool assembly comprises using pitch angle data, roll angle data, and the calibration factor to determine the orientation of the downhole tool assembly.

27. A method of determining the distance between a downhole tool assembly and a monitoring system, the method comprising:

positioning the downhole tool assembly and monitoring system a known distance from each other;

selecting a proportionality constant value;

transmitting a magnetic field from the downhole tool assembly;

detecting an intensity of the magnetic field transmitted from the downhole tool assembly;

calculating an estimated distance between the monitoring system and the downhole tool assembly based upon the detected intensity of the magnetic field and the selected proportionality constant value;

transmitting an operation instruction to the downhole tool assembly indicative of the estimated distance between the downhole tool assembly and the monitoring system;

changing the intensity of the magnetic field transmitted by the downhole tool assembly to obtain an adjusted magnetic field; wherein the adjusted magnetic field is based on the estimated distance calculated by the monitoring system equaling the known distance; and determining an unknown distance between the downhole tool assembly and the monitoring system during operation of the downhole tool assembly based on the selected proportionality constant and the adjusted magnetic field.

28. The method of claim 27 further comprising displaying the distance between the monitoring system and the downhole tool assembly at the monitoring assembly.

* * * * *